United States Patent [19]

Miner

[11] Patent Number: 4,765,625

[45] Date of Patent: Aug. 23, 1988

[54] PRACTICE DEVICE FOR PUTTING STROKES

[76] Inventor: Robert A. Miner, P.O. Box 650460, Vero Beach, Fla. 32965-0460

[21] Appl. No.: 94,614

[22] Filed: Sep. 9, 1987

[51] Int. Cl.[4] ..... A63B 69/36

[52] U.S. Cl. ..... 273/183 A; 273/195 R

[58] Field of Search ..... 273/183 A, 195 R

[56] References Cited

U.S. PATENT DOCUMENTS

| | | | |
|---|---|---|---|
| 1,819,896 | 8/1931 | Trish | 273/183 A |
| 2,096,055 | 10/1937 | Miller | 273/183 A |
| 2,750,195 | 6/1956 | Ching | 273/183 A |
| 2,992,005 | 7/1961 | Lockhart | 273/183 A |
| 3,312,474 | 4/1967 | Mitchell | 273/195 R |
| 3,934,882 | 1/1976 | Whittaker | 273/183 A |
| 4,544,161 | 10/1985 | Guandling | 273/187 A |

*Primary Examiner*—William L. Freeh

*Attorney, Agent, or Firm*—Sughrue, Mion, Zinn, Macpeak, and Seas

[57] ABSTRACT

The golf putting practice device is comprised of a flat, relatively thin, rigid, T-shaped member having an elongated base portion with a center line formed thereon. The crossbar of the T-shaped member is provided with a V-shaped notch with the apex of the V contiguous to one end of the center line of the base portion. The crossbar is provided with a base line which extends perpendicular to the center line and which intersects the apex of the V-shaped notch. A sighting bore is provided on the center line of the base portion is spaced relation to the base line of the crossbar and is provided with a circular indicia on the bottom wall thereof to ensure proper positioning of the golfer's head.

4 Claims, 1 Drawing Sheet

PRACTICE DEVICE FOR PUTTING STROKES

BACKGROUND OF THE INVENTION

The present invention is directed to a device to be used by golfers to practice putting and improve this essential part of the game of golf.

In Applicant's prior U.S. Pat. No. 4,544,160, a golf putting practice device was disclosed which includes a pair of elongated rigid strips that are held spaced apart and parallel by a transverse bar to define between their inner longitudinal edges a putter stroke area. A pair of plate members are moveable along each of the rigid strips and include lock elements to fix them at positions along the rigid strips selected by use of measurement indicia on the upper surface of the rigid strips. The transverse bar is adjustable to vary the spacing between the parallel strips and a further bar is secured to one of the moveable plate members and extends away from the strips to provide a foot location guide. In using the practice device, the ball is placed between the two rigid strips in front of an imaginary line extending between the forward ends of the two plate members, which are moveable along the rigid strips. The putter head operates in this space between the rigid strips. While the device is very helpful in providing the proper relationship between the putter head, the ball and the feet of a person holding the putter, it is sometimes difficult to properly align the face of the putter relative to the ball when the putter head has a rounded or other unusual configuration.

SUMMARY OF THE INVENTION

The present invention provides a new and improved golf putting practice device which can be used alone or in combination with the practice device described above, and disclosed in Applicant's prior patent No. 4,544,160, and which provides an extremely useful and accurate guidance system for insuring that the face of the putter is perpendicular to the desired path, that the putter head moves along the desired path during the entire putter stroke, and that the golfer's head is directly over the ball with the line of sight extending perpendicular to the device.

The present invention provides a new and improved golf putting device comprising a flat T-shaped member having linear indicia means extending the entire length of the base of the T-shaped member, two triangular projections disposed adjacent each other on the crossbar of the T-shaped member extending away from the base of the T-shaped member to define a triangular notch therebetween, with the apex thereof disposed in alignment with said linear indicia means, a bore having a bottom wall extending into said base on said linear indicia means in spaced relation to the crossbar and anchoring means projecting perpendicularly from the underside of said T-shaped member.

The foregoing and other objects, features and advantages of the invention will be apparent from the following more particular description of a preferred embodiment of the invention as illustrated in the accompanying drawings.

DETAILED DESCRIPTION OF THE INVENTION

Figure 1:
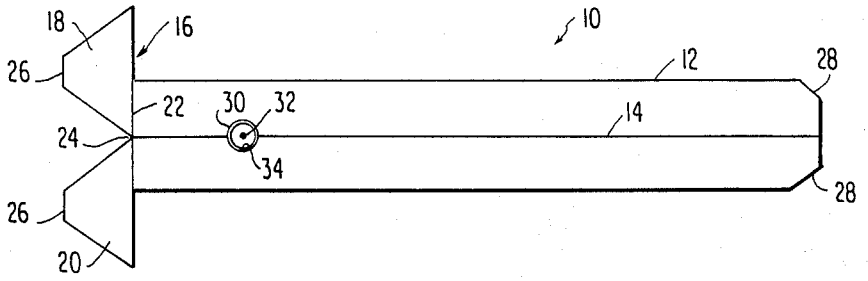
FIG. 1 is a plan view of the practice device according to the present invention.
Figure 2:
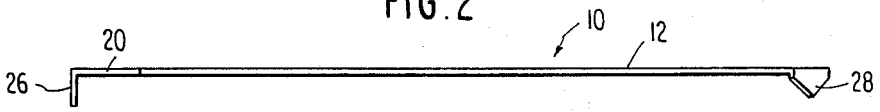
FIG. 2 is a side elevation view of the practice device according to the present invention.

The golf practice device 10, according to the present invention, is shown in FIGS. 1 and 2 and generally has the configuration of a "T-Square". The device consists of a flat, thin, one piece T-shaped member which may be formed of any suitable material, such as metal, wood, plastic, or the like. The base 12 of the T-shaped member has a substantially elongated, rectilinear configuration with a center indicia line or groove 14 extending the entire length thereof. The crossbar 16 of the T-shaped member is formed from two substantially triangular portions 18 and 20, having a common base line 22 and which are contiguous with each other at the point 24 which coincides with the center line 14 of the base portion 12.

If the golf practice device is made from metal having a thickness which allows bending of the metal, the apexes 26 of the two triangular portions 18 and 20 may be bent downwardly as best seen in FIG. 2, to define pointed projections for anchoring the device to the putting surface. Similarly, the corner portions 28 of the base portion 12 remote from the crossbar 16 may be bent downwardly to form pointed projections to assist in holding the putting device in place on the putting surface. Obviously, if the practice device is made of plastic material, the pointed projections can be molded integrally with the device or separate projections may be secured to the practice device regardless of the material used.

In order to insure that the head and eyes of the golfer are properly positioned over the ball, a bore 30 is formed in the base portion 12 on the center line 14 thereof in spaced relation to the base line 22 of the crossbar 16. The spacing between the bore 30 and the base line 22 is sufficient to allow most putter heads to be placed with the putting face closely adjacent and parallel to the base line while leaving the bore 30 unobscured. A dot 32 is located in the center of the bottom surface of the bore and a circular line 34 of a contrasting or bright color is formed at the intersection of the side wall and bottom of the bore. The line 34 has been illustrated as being slightly spaced from the line of intersection between the side wall of the bore and the bottom for purposes of illustration only. Thus, when the golfer's head is in the correct position over the ball, the golfer will be looking directly down at the ball, the putter head, and the bore, and be able to see the entire circle 34 on the bottom of the bore.

Figure 3:
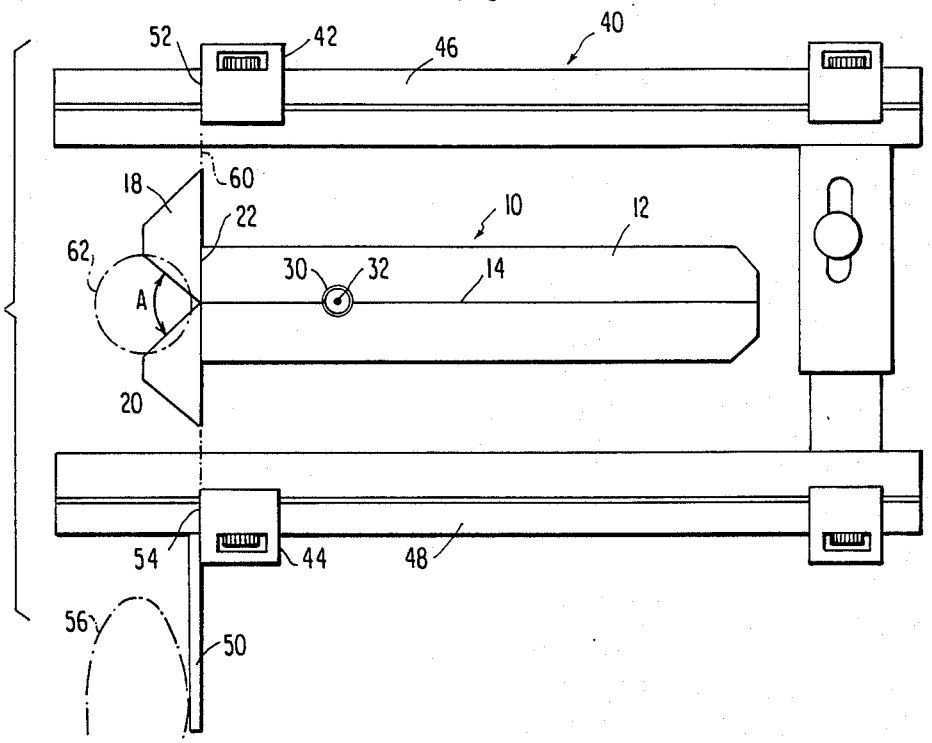
FIG. 3 is a plan view of the practice device according to the present invention, in combination with applicant's prior art practice device.

The golf practice device 10 of the present invention is shown in FIG. 3 in combination with the golf practice device 40 of applicant's prior patent No. 4,544,160. While a detailed description of the prior golf practice device 40 is not necessary, it is pointed out that the plate members 42 and 44 are slidably adjustable along the elongated side members 46 and 48, respectively. The forward surfaces 52 and 54 on the plate members 42 and 44, respectively, define an imaginary line extending between the side portions 46 and 48, along which the face of the putter is to be aligned. The bar 50 secured to the forward face 54 of the plate 44 provides a positioning guide for the left foot 56 of a golfer. Since it is sometimes difficult for a golfer to align the face of the putter with the imaginary line extending between the front faces 52 and 54 of the plates 42 and 44, the golf practice device 10, according to the present invention, may be placed in the area defined by the U-shaped golf practice device 40 of the prior patent. The base line 22 can more readily be aligned along the imaginary line 60 so that the golfer will have a real line, namely the base line 22 along which to align the face of the putter.

The angle A between the two triangular portions 18 and 20 of the crossbar provide a locating means for the ball 62 so that the rear edge of the ball is positioned substantially adjacent the base line 22, with the center of the ball aligned with the center line 14 of the practice device 10. Thus, with the putter head in place behind the base line 22 with the face thereof aligned parallel with the base line 22, the center of the putter head, if defined by a mark on the putter, can be accurately positioned along the line extending between the center of the ball 62, the center point 24 of the base line 22, the center line 14 of the base member 12, and the dot 32 on the bottom wall of the bore 30. In this way, the putter head will be accurately positioned initially and the center line 14 can provide a visual guide for the back stroke and the forward stroke of the putter head to ensure that the putter will make perfect contact with the ball.

The golf practice device 10 according to the present invention can be used alone or in combination with the golf practice device of applicant's prior patent No. 4,544,160. The details of the construction of the practice device 10 may vary as long as the essential features of the center line 14, base line 22, and the angle A are provided in conjunction with the bore 30. Depending upon the thickness of the material from which the golf practice device 10 is made, the bore 30 may be a blind bore or may be an aperture extending entirely through the material. In the latter case, a separate piece of material would be secured by means of an adhesive, or any other suitable means, to the under surface of the base member 12 to provide a bottom for the bore 30, upon which the markings 32 and 34 may be placed.

While the invention has been particularly shown and described with reference to preferred embodiments thereof, it will be understood by those in the art that the foregoing and other changes in form and details may be made therein, without departing from the spirit and scope of the invention.

What is claimed is:

1. A golf practice device comprising:

a flat T-shaped member having a base portion and a crossbar, indicia means extending the length of the base portion to define a center line, a V-shaped notch formed in said crossbar with the apex of the V-shaped notch contiguous to one end of said center line, and a base line on said crossbar extending perpendicular to said center line and intersecting said apex.

2. A golf putting practice device as set forth in claim 1, further comprising a bore located in said base portion on said center line, said bore having a bottom surface provided with substantially circular indicia adjacent the wall of said bore to provide a sighting aid.

3. A golf putting practice device as set forth in claim 2, wherein said device is comprised of a thin, flat substantially rigid one piece member having downwardly projecting means thereon for holding said device on a putting surface.

4. A golf putting practice device as set forth in claim 3, wherein said device is comprised of metal with portions of said crossbar and said face portion being bent downwardly to define said projections.

* * * * *